US007509079B2

(12) United States Patent
Muramatsu et al.

(10) Patent No.: US 7,509,079 B2
(45) Date of Patent: Mar. 24, 2009

(54) TONER, TONER CONVEYING APPARATUS AND METHOD, AND IMAGE FORMING APPARATUS

(75) Inventors: Satoshi Muramatsu, Tokyo-to (JP); Nobuo Kasahara, Kanagawa-ken (JP); Nobuo Iwata, Kanagawa-ken (JP); Junichi Matsumoto, Kanagawa-ken (JP)

(73) Assignee: Ricoh Company, Ltd., Tokyo (JP)

( * ) Notice: Subject to any disclaimer, the term of this patent is extended or adjusted under 35 U.S.C. 154(b) by 48 days.

(21) Appl. No.: 11/481,821

(22) Filed: Jul. 7, 2006

(65) Prior Publication Data

US 2006/0251983 A1 Nov. 9, 2006

Related U.S. Application Data

(62) Division of application No. 10/440,098, filed on May 19, 2003, now Pat. No. 7,076,191.

(30) Foreign Application Priority Data

May 17, 2002 (JP) ..... 2002-142601

(51) Int. Cl.
*G03G 9/08* (2006.01)

(52) U.S. Cl. ..... 399/258; 430/120.1

(58) Field of Classification Search ..... 430/111.4, 430/120, 120.1; 399/258
See application file for complete search history.

(56) References Cited

U.S. PATENT DOCUMENTS

| | | | |
|---|---|---|---|
| 5,422,214 | A | 6/1995 | Akiyama et al. |
| 5,683,845 | A | 11/1997 | Sata et al. |
| 5,875,380 | A | 2/1999 | Iwata et al. |
| 5,953,567 | A | 9/1999 | Muramatsu et al. |
| 5,987,298 | A | 11/1999 | Muramatsu et al. |
| 6,080,519 | A | 6/2000 | Ishiyama et al. |
| 6,112,046 | A | 8/2000 | Suzuki et al. |
| 6,163,669 | A | 12/2000 | Aoki et al. |
| 6,201,941 | B1 | 3/2001 | Kasahara et al. |
| 6,227,768 | B1 | 5/2001 | Higuchi et al. |
| 6,282,396 | B1 | 8/2001 | Iwata et al. |
| 6,295,437 | B1 | 9/2001 | Hodoshima et al. |
| 6,381,435 | B2 | 4/2002 | Shinohara et al. |
| 6,393,241 | B1 | 5/2002 | Matsumoto et al. |

(Continued)

FOREIGN PATENT DOCUMENTS

JP 2-123371 5/1990

(Continued)

OTHER PUBLICATIONS

Mechanics and physics measuring apparatus of the powder flow layer, Powder bed tester by Sankyo Piotech Co., Ltd., Japan, Jun. 1998, pp. 1 to 6. Japanese with partial English translation.

*Primary Examiner*—John L Goodrow
(74) *Attorney, Agent, or Firm*—Oblon, Spivak, McClelland, Maier & Neustadt, P.C.

(57) ABSTRACT

A toner for forming a visual image on an image bearer having a maximum shearing stress of about 30 G ($N/m^2$) when a maximum shearing stress test is performed using a uniaxial collapsing stress measuring method and a vertical stress 16 G ($N/m^2$) is applied. Alternatively the toner has a uniaxial collapsing stress of about 50 G ($N/m^2$).

28 Claims, 15 Drawing Sheets

U.S. PATENT DOCUMENTS

| | | | | |
|---|---|---|---|---|
| 6,507,720 | B2 | 1/2003 | Kabumoto et al. | |
| 6,526,246 | B2 | 2/2003 | Iwata et al. | |
| 6,542,707 | B2 | 4/2003 | Muramatsu et al. | |
| 6,567,637 | B2 | 5/2003 | Yanagisawa et al. | |
| 6,571,076 | B2 | 5/2003 | Kasahara et al. | |
| 6,597,883 | B2 | 7/2003 | Muramatsu et al. | |
| 6,678,492 | B1 | 1/2004 | Terazawa et al. | |
| 2001/0021326 | A1* | 9/2001 | Yanagisawa et al. | 399/258 |
| 2002/0012551 | A1* | 1/2002 | Tsutsui et al. | 399/252 |
| 2002/0106221 | A1* | 8/2002 | Muramatsu et al. | 399/258 |
| 2003/0016966 | A1* | 1/2003 | Hattori et al. | 399/258 |

FOREIGN PATENT DOCUMENTS

| | | |
|---|---|---|
| JP | 5-341565 | 12/1993 |
| JP | 6-19199 | 1/1994 |
| JP | 6-194866 | 7/1994 |
| JP | 7-160044 | 6/1995 |
| JP | 9-79966 | 3/1997 |
| JP | 9-204064 | 8/1997 |
| JP | 10-186840 | 7/1998 |
| JP | 2000-137376 | 5/2000 |
| JP | 2000-275964 | 10/2000 |
| JP | 2000-356898 | 12/2000 |
| JP | 2000-91143 | 3/2002 |
| JP | 2002-108081 | 4/2002 |
| JP | 2002-006536 | 9/2002 |

* cited by examiner

FIG. 20

| TONER | UNIAXIAL COLLAPSING STRESS fc [g/cm$^2$] | TONER CLOG IN SUCTION PIPE |
|---|---|---|
| A | 2.9 | NOTHING |
| B | 3.5 | NOTHING |
| C | 3.7 | NOTHING |
| D | 4.1 | NOTHING |
| E | 4.5 | NOTHING |
| F | 4.8 | NOTHING |
| G | 5.2 | PRESENCE |
| H | 6.8 | PRESENCE |
| I | 12.5 | PRESENCE |

FIG. 21

| TONER | MAXIMUM SHEARING STRESS WHEN VERTICAL STRESS 1.6[g/cm$^2$] IS APPLIED $\tau$ max [g/cm$^2$] | TONER CLOG IN SUCTION PIPE |
|---|---|---|
| A | 2.4 | NOTHING |
| B | 2.5 | NOTHING |
| C | 2.5 | NOTHING |
| D | 2.8 | NOTHING |
| E | 2.9 | NOTHING |
| F | 2.9 | NOTHING |
| G | 3.1 | PRESENCE |
| H | 3.6 | PRESENCE |
| I | 5.4 | PRESENCE |

TONER, TONER CONVEYING APPARATUS AND METHOD, AND IMAGE FORMING APPARATUS

CROSS REFERRENCE TO RELATED APPLICATION

This application claims priority under 35 USC §119 to Japanese Patent Application No. 2002-142601 filed on May 17, 2002, the entire contents of which are herein incorporating by reference.

BACKGROUND OF THE INVENTION

1. Field of the Invention

The present invention relates to toner capable of developing a latent image, a toner conveying apparatus, and an image forming apparatus utilizing such toner.

2. Discussion of the Background

It is known that an image forming apparatus employs and conveys toner from a toner container to a prescribed position in the image forming apparatus. Such an image forming apparatus employs an electrophotographic system including a toner container containing replenishing toner, and conveys toner to a developing device. The toner conveyed to the developing device develops a latent image formed on a latent image carrier such as a drum shaped photoconductive member, etc. Another type of an image forming apparatus includes a toner recovery container for containing toner recovered by a cleaning device from a latent image carrier after a toner image has been transferred, and conveys the toner to a discarding toner vessel and the developing device.

In such image forming apparatuses, the toner is conveyed in various manners. For example, the toner is moved and conveyed inside a conveyance pipe connecting a conveyance source to its destination by rotating a coil screw arranged therein.

A toner conveyance destination is located right under a conveyance source so as to drop and convey toner by gravity. Still another image forming apparatus sucks and conveys toner stored in a toner container using a suction pump.

Among these apparatuses, the image forming apparatus conveying the toner by rotating the coil screw has a low degree of a layout freedom, because the conveyance pipe housing the coil screw and a toner conveyance path have to be straight. Further, the image forming apparatus dropping and conveying the toner by gravity has also a low degree of a layout freedom, because the conveyance destination is located right under the conveyance source.

The image forming apparatus that conveys toner by the suction pump does not have to house a conveyance member such as a coil screw in a suction pipe, which connects a suction inlet of the suction pump to a toner container, or an ejection pipe, which connects an ejection outlet of the suction pump to a conveyance destination. Thus, flexible pipes may be used for the suction and ejection pipes and thereby the toner conveyance path is freely designed.

However, depending upon a shape of a toner container, toner adhered to an inner surface of the toner container coalesces with ambient toner and forms a lump, thereby generating the so-called toner blocking phenomenon. As a result, the toner occasionally does not flow into the suction pipe. Then, a type of an image forming apparatus enabling a suction pipe to suck toner and supply air at same time enters the field. According to this type, because the toner in the toner container is stirred and the toner blocking is accordingly disrupted by air pressure and flow caused by the air supply, the toner in the toner container can arrive at the suction pipe. However, toner also clogs in this type of apparatus.

Specifically, according to the type performing the toner suction and air supply at same time, the suction pump operates before the air supplied by the air pump is sufficiently filled in the toner container. Thus, stirring of toner in the toner container is significantly inefficient. Accordingly, the toner suction and air supply occurs at different times.

However, when an air pump is only operated for the purpose of supplying air independently, an inner pressure of the suction pipe is affected and increased by the air supply, thereby promoting coagulation and introducing toner clogging therein.

SUMMARY OF THE INVENTION

Accordingly, an object of the present invention is to address and resolve the above-noted and other problems and to provide a novel toner.

The above and other objects are achieved according to the present invention by providing a novel toner that sticks to an image bearer and forms a toner image. A maximum shearing stress of the toner is about 30 G ($N/m^2$) when a vertical stress 16 G ($N/m^2$) is applied thereto.

In another embodiment, a uniaxial collapsing stress of the toner is about 50 G ($N/m^2$).

In yet another embodiment, a toner conveying apparatus includes a toner-containing device and conveys toner to a prescribed destination therefrom. The toner containing device includes an air supplying device configured to supply the toner containing device with air, a suction pipe connected to the toner containing device, and a suction pump configured to generate a negative pressure in the suction pipe and suck toner stored in the toner containing device. A maximum shearing stress of the toner is about 30 G ($N/m^2$) when and a vertical stress 16 G ($N/m^2$) is applied thereto.

In yet another embodiment, an image forming apparatus forms an image by applying toner to an image bearer. The image forming apparatus includes a toner-containing device configured to contain toner, and a toner conveying device configured to convey the toner stored in the toner-containing device to the prescribed destination. A maximum shearing stress of the toner is about 30 G ($N/m^2$) when a vertical stress of 16 G ($N/m^2$) is applied thereto.

In yet another embodiment, a latent image bearer is configured to bear a latent image thereon. A developing device serves as the prescribed destination.

In yet another embodiment, a lifting range between the toner-containing device and the prescribed destination, and the entire length of the suction pipe are less than 1 meter. A negative pressure generated by the suction pump amounts to more than 10 (kilo-PASCAL).

BRIEF DESCRIPTION OF THE DRAWING

A more complete appreciation of the present invention and many of the attendant advantages thereof will be readily obtained as the same becomes better understood by reference to the following detailed description when considered in connection with the accompanying drawings, wherein:

FIG. 20 is a table illustrating results of a test measuring a relation between the uniaxial collapsing stress of toner and the clogging of toner; and FIG. 21 is a table illustrating results of a test measuring a relation between the maximum shearing stress of toner and the clogging of toner.

DETAILED DESCRIPTION OF THE PREFERRED EMBODIMENT

Figure 1:
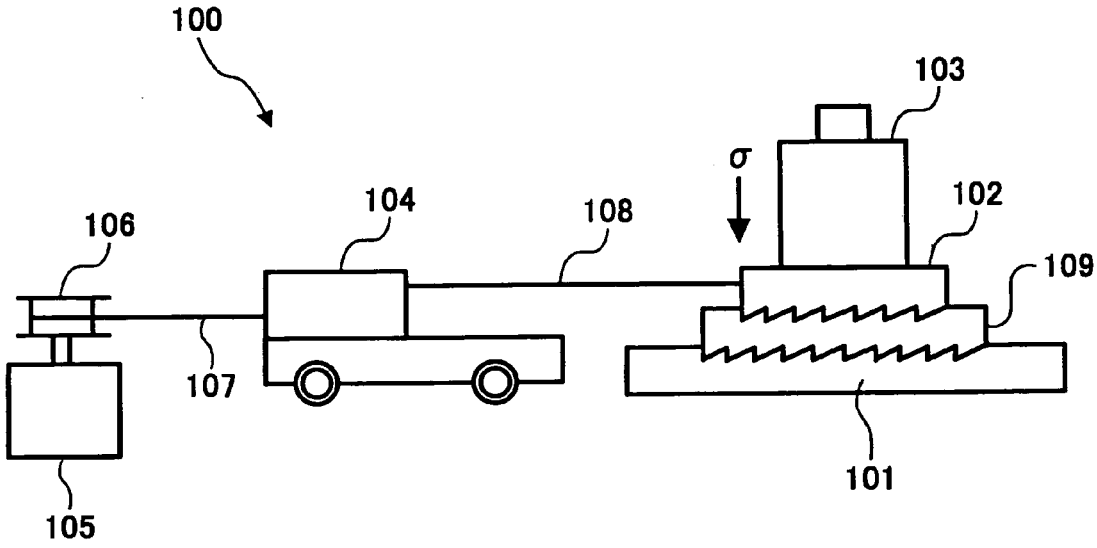
FIG. 1 is a picture diagram illustrating a shearing testing machine for measuring maximum shearing and uniaxial collapsing stresses of toner.

Referring now to the drawings, wherein like reference numerals and marks designate identical or corresponding parts throughout the several views, the present invention will be described.

The present inventors have investigated an air supplying pressure and air supplying frequency of an air pump, which can suppress toner clogging in a suction tube. The inventors determined a toner clogging generation condition depends upon a type of toner, even in the same conditions of the air supplying pressure and frequency. Attention was then directed to a performance of the toner, and the toner clogging generation condition was repeatedly investigated using various types of toners. As a result, the inventors advantageously determined that the toner clogging in the suction tube is closely related to a fluidity of the toner.

Turning now to FIG. 1, which illustrates a typical shearing testing machine used to measure a maximum shearing stress and a uniaxial collapsing stress of toner. The testing machine is a known type capable of measuring a maximum shearing stress and uniaxial collapsing stress each serving as a reference index of a fluidity of a fine particle.

As shown in FIG. 1, the shearing testing machine 100 includes a fixed plate 101 having saw tooth like uniform concavity and convexity on its upper surface, a movable plate 102 having saw tooth like uniform concavity and convexity on its lower surface, a sash weight 103, and a load cell 104 movable due to its four wheels. Also included are a driving motor 105 for driving the load cell 104, a reel 106 secured to a driving shaft of the driving motor 105, a conducting wire 107 wound around the reel 106, and a connection wire 108 connecting the load cell 104 to the movable plate 102.

On the fixed plate 101 fixed with its saw tooth like surface facing upward, a fine particle layer 109 as a testing objective is laid upon the face, and the movable plate 102 is then mounted on the fine particle layer 109 with its saw tooth surface directed downward. Specifically, the fine particle layer 109 is sandwiched between the saw tooth upper surface of the fixed plate 101 and the lower saw tooth surface of the movable plate 102. The sash weight 103 is then mounted on the moveable plate 101. Thus, a prescribed amount of a vertical stress is applied to the fine particle layer by the sash weight and movable plate 101. Further, one end of the connection wire 108 is connected to the movable plate 102, and the other end is connected to a rear side of the load cell 104, respectively.

The load cell 104 is movable due to the four wheels, and is connected to one end of the conduction wire 107 wound around the reel 106 at its front side. In connection with rotation of the driving motor 105, the reel 106 rolls up the conduction wire 107, and thereby the load cell 104 is drawn and moves forward. Further, due to movement of the movable plate 102 in connection with the movement of the load cell 104, a shearing stress is applied to the fine particle layer 109.

Further, the present inventors also measured a uniaxial collapsing stress of various types of toner using a uniaxial collapsing stress measuring method in the above-mentioned shearing testing machine. The uniaxial collapsing measuring method is executed as follows. First, a fine particle layer having a volume of around 50 mm×70 mm×6 mm is set on the fixed plate 101. Then, a pre-pressure of about 700 G[Nm$^2$] (70 g/cm$^2$) is applied thereto by weights of the movable plate 102 and sash 103 for about five minutes. Then, the sash weight 103 is changed to have less weight and a vertical stress σ of less than 200 G (N/m$^2$) (20g/cm$^2$) is applied to the fine particle layer (e.g., toner layer).

Figure 2:
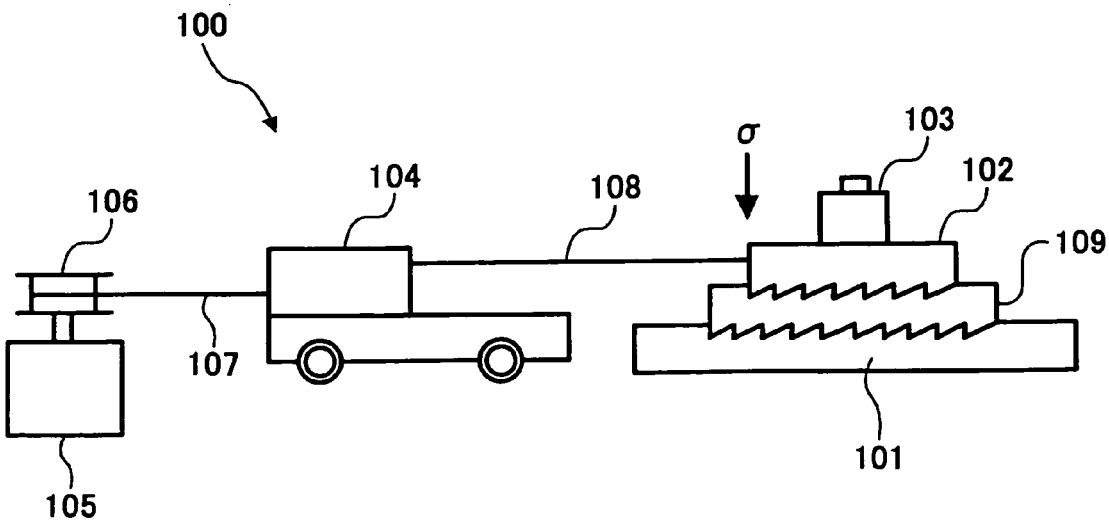
FIG. 2 is another picture diagram illustrating a shearing testing machine.
Figure 3:
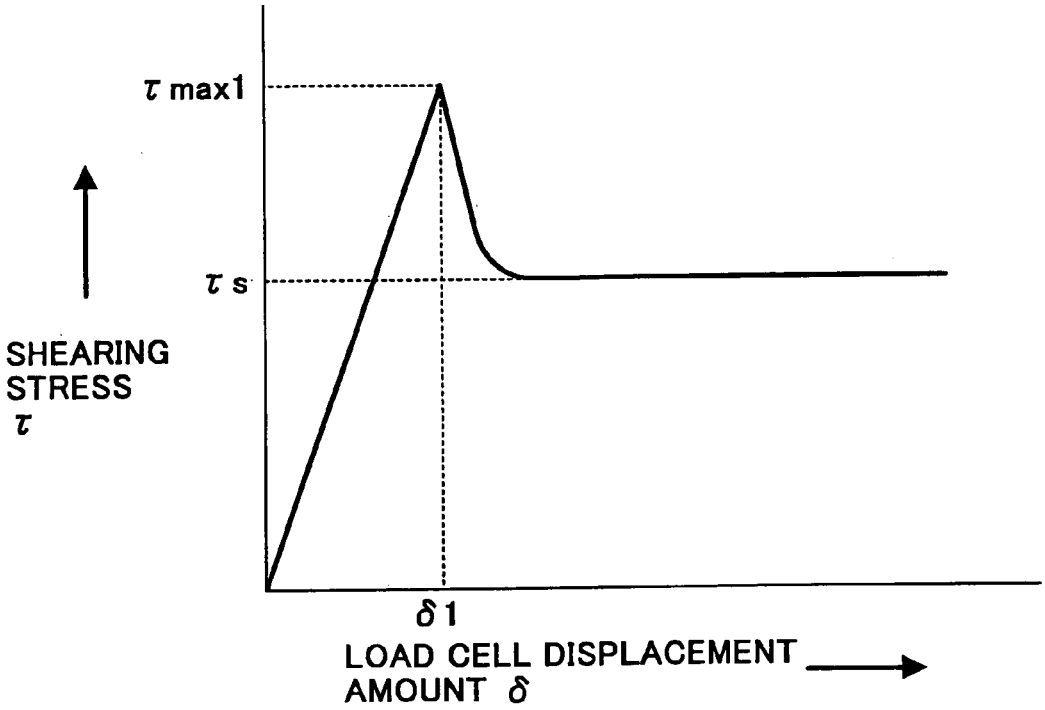
FIG. 3 is a graph illustrating a relation between a displacement δ of a load cell of the shearing testing machine and a shearing stress τ applied to a fine particle layer.

Then, as illustrated in FIG. 2, a shearing stress is applied to the fine particle layers while the load cell 104 is horizontally moved one step at a time and the vertical stress σ is applied. Then, a relation between a displacing amount σ of the load cell 104 and a shearing stress τ applied to the fine particle layer is obtained as illustrated in FIG. 3. Specifically, the shearing stress r applied to the toner increases in proportion to an increase in the displacing amount δ of the load cell 104. In addition, when the displacing amount is δ1, the toner layer collapses, and the maximum shearing stress τ max 1 appears when a vertical stress σ is applied. After the fine particle layer has collapsed, the shearing stress τ indicates a constant values τ s.

Further, when the uniaxial collapsing stress measuring method is executed, and the maximum shearing stresses τ max is measured at more than two different vertical stresses σ, and an approximate line formula is obtained as a relational expression between a vertical stress σ and a maximum shearing stress τ max based upon the measurement, a uniaxial collapsing stress fc is obtained as a diameter of a circle that contacts both the approximate line and an origin of σ-τ axes coordinates of the approximate line.

Figure 4:
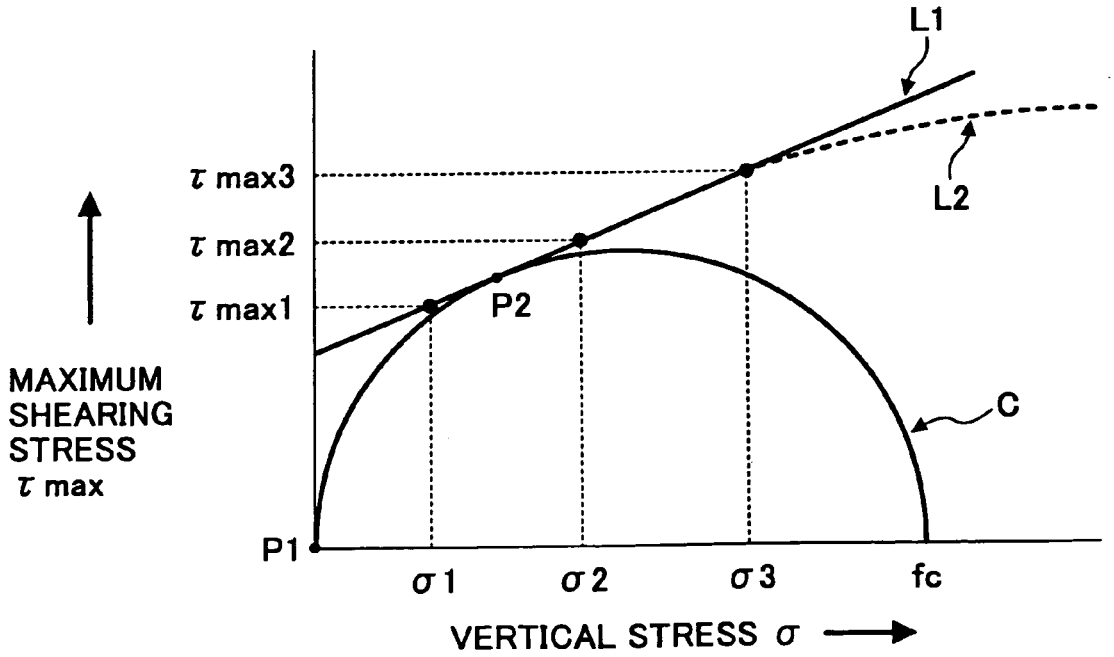
FIG. 4 is a graph illustrating a relation between a vertical stress σ, which is set to the shearing testing machine and applied to toner, and the maximum shearing stress τ max.

FIG. 4 graphically illustrates a relation between a vertical stress σ and a maximum shearing stress $\tau_{max}$. As shown, an approximate line L1 is obtained by finding respective maximum shearing stresses $\tau_{max\ 1}$, $\tau_{max\ 2}$, and $\tau_{max\ 3}$ for three different vertical stresses σ1, σ2, and σ3. In a narrow sense, when a larger number of vertical stresses σ are measured at many points, the relation between the vertical stress σ and maximum shearing stress $\tau_{max}$ indicates a breakdown envelope curve L2. However, in the uniaxial collapsing stress measuring method, the approximate line L1 is used instead of the breakdown envelope curve L2. Then, a uniaxial collapsing stress fc is obtained as a diameter (i.e., an intercept on the a axis) of a circle contacting both the origin P1 of the σ-τ axes coordinates of the approximate line L1 and the approximate line L1 at a point P2. As understood from FIG. 4, vertical stresses σ in the vicinity of the contacting point P2 where the circle C contact the approximate line L, a uniaxial collapsing stress fc on the approximate line L1 and that on the breakdown envelope curve L2 are substantially the same.

By using nine types (e.g., from A to I types) of toner whose particle diameters are almost the same and each having a different fluidity, the present inventors tested a relation between a uniaxial collapsing stress fc measured by a uniaxial collapsing stress measuring method and clogging of toner in the suction pipe. The toner clogging was inspected in an electro-photographic printer having a toner conveying apparatus for conveying toner to a developing apparatus while sucking the toner and supplying air at same time. The testing machine meets the below listed conditions applicable to almost all printers and copiers.

The length of the toner-conveying path (from suction pipe end to suction pipe tip) or lifting height: From 0.3 to 1.0 meter Length of suction pipe: 0.5 meter Inner diameter of suction pipe: 6 millimeters Sucking force of suction pump: From 10 to 30 kilo PASCAL Maximum pressure in suction tube when air is supplied: 30 kilo PASCAL Frequency of supplying air: Once per thirty seconds (for one second)

Flowing amount of air: Two liters per minute

A result of the testing is shown in the table illustrated in FIG. 20.

As shown in FIG. 20, the toner does not clog when its uniaxial collapsing stress fc is less than 4.8 (g/cm$^2$). In contrast, the toner clogs when its uniaxial collapsing stress fc is more than 5.2 (g/cm$^2$). Further, after detailed inspection of a uniaxial collapsing stress fc in the vicinity of a boarder between the toner clogging and the toner not clogging, it was determined a critical point where the toner does not clog is substantially 5.0 (g/cm$^2$). The uniaxial collapsing stress fc has been conventionally used as a reference index representing a fluidity of a fine particle. However, according to the investigation, it was proved the uniaxial collapsing stress fc is also useful as a reference index representing a toner-clogging tendency in the suction pipe. The above-mentioned amount of 5.0 (g/cm$^2$) corresponds to 50 G (N/m$^2$), where the legend "G" represents acceleration of gravity of about 9.80665.

Figure 5:
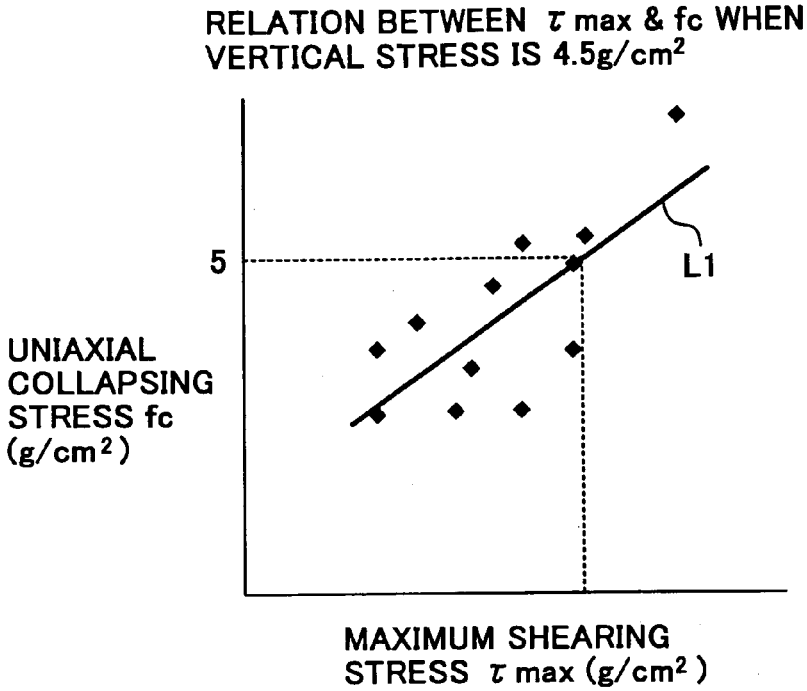
FIG. 5 is a graph illustrating a relation between a maximum shearing stress τ max of toner, which receives a vertical stress $\sigma$=4.5 g/cm$^2$ from the shearing testing machine, and a uniaxial collapsing stress Fc.
Figure 6:
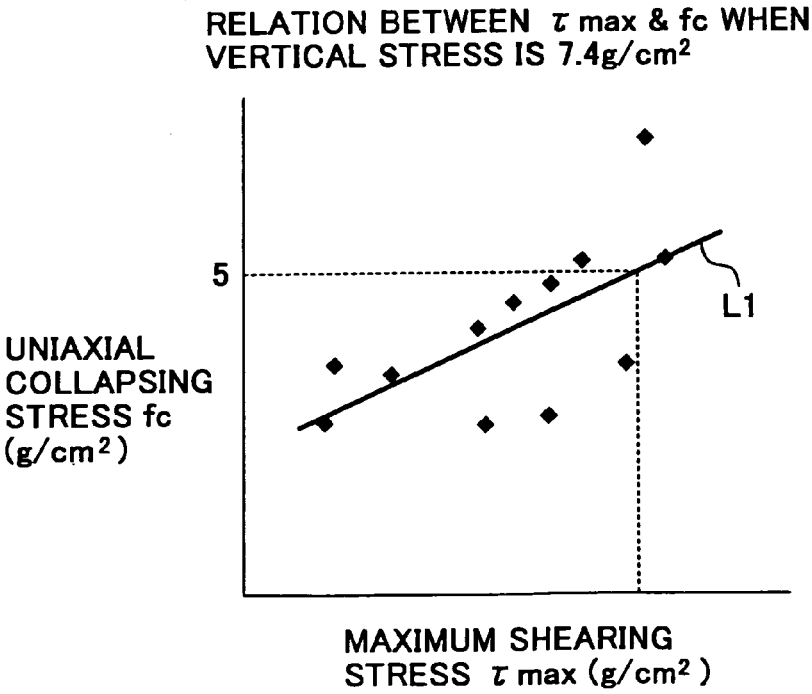
FIG. 6 is a graph illustrating a relation between a maximum shearing stress τ max of toner that receives a vertical stress $\sigma$=7.4 g/cm$^2$ from the shearing testing machine and a uniaxial collapsing stress Fc.

The present inventors also determined an interesting phenomenon during use of the uniaxial collapsing stress measuring method. Specifically, the uniaxial collapsing stress measuring method necessarily measures maximum shearing stresses τ max at more than two vertical stresses a per one testing objective (i.e., a fine particle layer). Because, if a certain level of correlation between the maximum shearing stress τ max and uniaxial collapsing stress fc can be obtained, a maximum shearing stress τ max is enough when measured at only a prescribed vertical stress σ. However, the correlation is not precise. FIGS. 5 and 6 illustrate relations between the maximum shearing stress τ max and uniaxial collapsing stress fc when vertical stresses of 4.5 and 7.4 (g/cm$^2$) are applied, respectively. As understood therefrom, each set of plotted coordinates is dispersed while largely deviating from the approximate line L1. Specifically, a coefficient of precise correlation between the maximum shearing stress τ max and uniaxial collapsing stress fc is not obtained.

Figure 7:
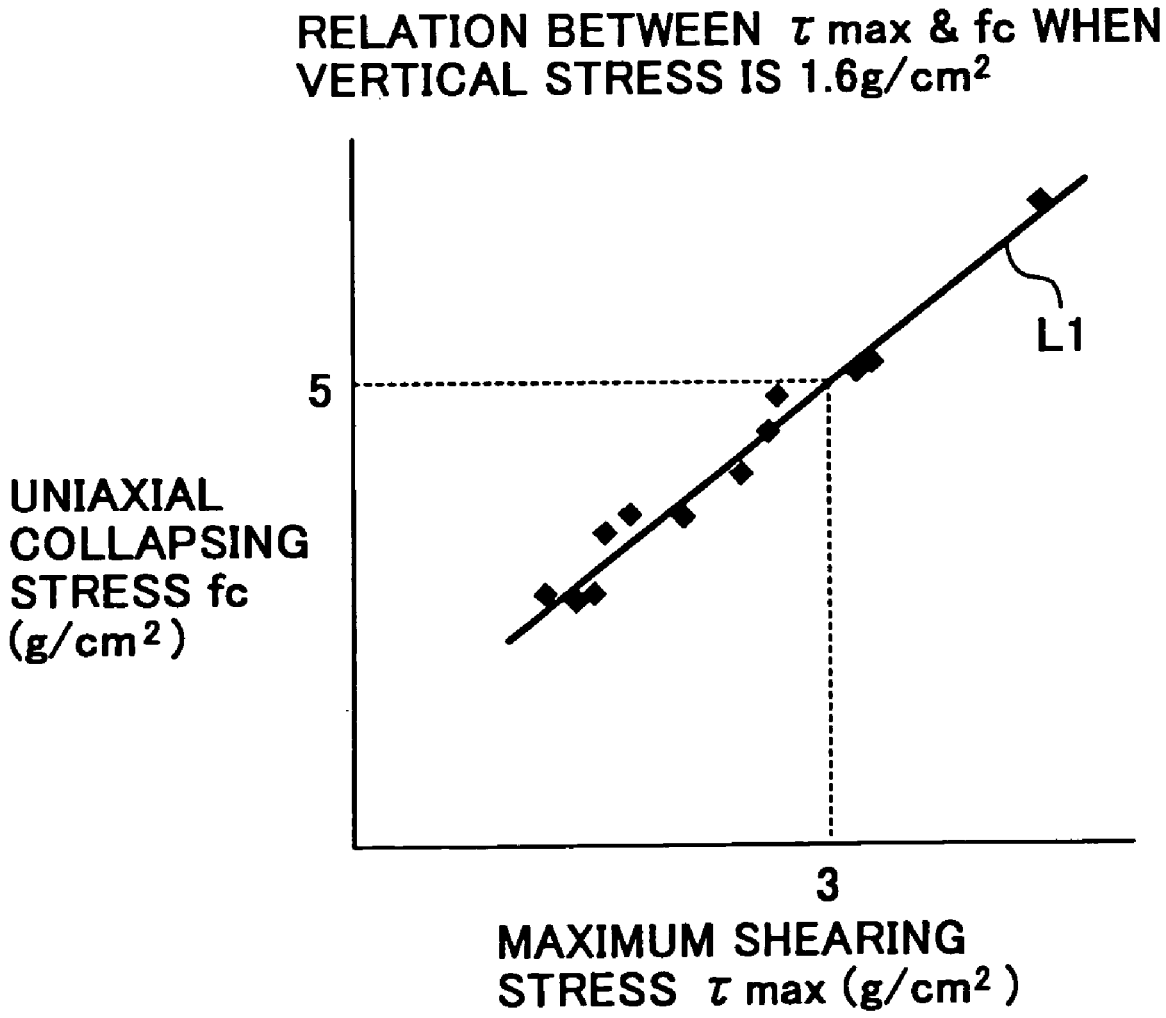
FIG. 7 is a graph illustrating a relation between the maximum shearing stress τ max of toner, which receives a vertical stress $\alpha$=7.4 g/cm$^2$ from the shearing testing machine, and a uniaxial collapsing stress Fc.

However, when a similar graph is drawn for a vertical stress of 1.6 (g/cm$^2$), a significantly precise correlation unexpectedly appears as illustrated in FIG. 7. Then, the present inventors studied a relation between a maximum shearing stress τ max, which appears when the vertical stress of 1.6 (g/cm$^2$) is applied, and the existence of toner clogging. The relation is shown in the table of FIG. 21. As shown in FIG. 21, toner having a maximum shearing stress τ max of 2.9 (g/cm$^2$) at the vertical stress of 1.6 (g/cm$^2$) does not clog. In contrast, the toner having a maximum shearing stress τ max of 3.1 (g/cm$^2$) clogs. After investigating the maximum shearing stress τ max in the vicinity of a boundary between toner clogging and the toner not clogging, it was determined a critical point causing toner not to clog is substantially 3.0 (g/cm$^2$). Thus, the maximum shearing stress τ max under the vertical stress of 1.6 (g/cm$^2$) is useful as a reference index representing toner clogging tendency in the suction pipe. The above-mentioned amounts of shearing stresses of 1.6 and 3.0 (g/cm$^2$) can be transcribed to 16 G and 30 G (N/m), respectively.

Figure 8:
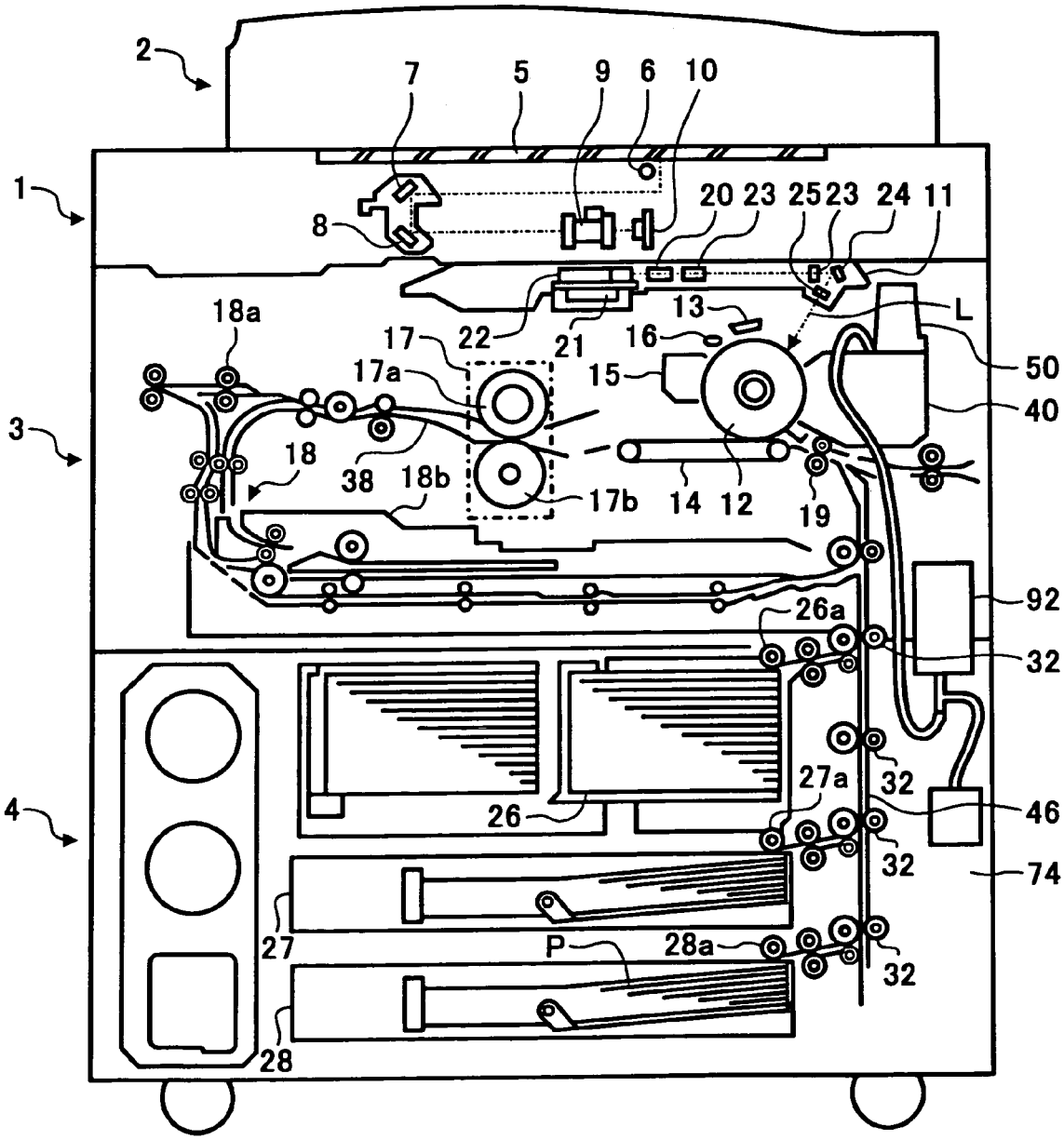
FIG. 8 is a schematic illustrating a configuration of a copier.

A first example of an image forming apparatus using an electrophotographic system (herein after referred to as a copier) using the above-described cloggless toner is now described with reference to FIG. 8. As shown, the copier includes an original document reading section 1, an automatic document feeding section 2, a printing section 3, and a sheet feeding section 4.

The automatic document feeding section 2 carries original documents, not shown, at its upper surface and automatically supplies the original documents onto a platen glass 5. The original document reading section 1 reads an image of the original document. When a user manually sets an original document on the platen glass 5 secured to the original document reading section 1, and operates a start switch (not shown) the original document reading section 1 immediately starts reading. When an original document is set on the automatic document feeding section 2, and a start switch is operated, the original document reading section 1 starts reading after the original document is automatically fed onto the platen glass 5. The original document set on the platen glass 5 is irradiated by a light source 6 moving rightward when the reading is started. A light image reflected from the original document is further reflected by first and second mirrors 7 and 8 one after another. Then, the light image passes through an imaging lens 9. Image information thereof is then read by an image sensor 10 formed from a CCD or the like capable of reading the reflected light image.

The printer section 3 includes an optical writing unit 11 and a drum shaped photoconductive member (hereinafter referred to as a PC member) 12 that forms a toner image on a transfer sheet P. The printer section 3 further includes a charging device 13, a developing device 40, a transferring and conveying unit 14, a cleaning device 15, and a charge removing device 16 or the like around the PC member 12. Further, a fixing device 17, a sheet inverting and ejecting unit 18, and a pair of registration rollers 19 are also included. When the start switch is operated, a driving device (not shown) rotates the PC drum 12.

The optical writing unit 11 modulates and exposes the PC member 12 with a laser light "L" in accordance with an image signal read by the original document reading section 1. Specifically, the laser light "L" is irradiated from a light source 20 formed from a laser diode, for example. The laser light "L" passes through a scanning and imaging lens system 23 formed from a f θ lens while being deflected in a main scanning direction (i.e., in a direction in parallel with an axis of the PC drum 12) by a rotational multiple mirror 22 driven and rotated by a polygon motor 21. Then, the laser light "L" passes through a mirror 24 and a lens 25, and arrives at the PC drum member 12 driven and rotated so as to scan and form a latent image on the surface thereof.

The transferring and conveying unit 14 is formed from a transferring and conveying belt suspended with tension by plural rollers. The transferring and conveying belt 14 forms a transfer nip by contacting the belt 14 to the circumferential surface of the PC drum member 12. A transfer bias roller, not shown, is contacted to a backside (i.e., an inner circumferential surface of a hoop) of the belt 14 at the transfer nip. A transfer bias is applied to the transfer bias roller by a power supply (not shown) so as to form a transfer electric field at the transfer nip.

The latent image formed on the PC member 12 after the exposure by the optical writing unit 11 is developed by the developing device 40 to be a toner image. The toner image then enters into the transfer nip. The pair of registration rollers 19 pinches a transfer sheet P fed by the sheet feeding section 4 driven in response to the operation of the start switch. The pair of registration rollers 19 then sends the transfer sheet in synchronism with a toner image carried on the PC drum member 12 at the transfer nip. Due to such a sending manner, the toner image sticks to the transfer sheet at the transfer nip. Then, the toner image is affected by the transfer electric field and nip pressure to be transferred to the surface of the transfer sheet. The transfer sheet having passed through the transfer nip is conveyed by the belt 14 to a fixing device 17. In the fixing device 17, the transfer sheet P is pinched by heating and pressure applying rollers 17*a* and 17*b*. The heating and pressure applying rollers 17*a* and 17*b* fix the toner image to the transfer sheet P with heat and pressure, and then eject the transfer sheet toward the sheet inverting and ejecting unit 18.

The sheet inverting and ejecting unit 18 ejects the transfer sheet to a sheet ejection tray (not shown) through a sheet ejection path. When a user selects a duplex copy mode, the transfer sheet travels along an inverting section 18*b* to be inverted, and then conveyed toward the pair of registration rollers 19. Thus, the transfer sheet is fed again to the transfer nip from the pair of registration rollers 19, and receives a new toner image on the other surface of the transfer sheet P.

The cleaning device 15 cleans the PC member 12 at its portion downstream of the transfer nip by removing toner sticking to the surface of the PC member 12. The removed toner is stored in a recovery tank. The surface of the PC member 12 is also uniformly charged by the charging device 13 after being cleaned and discharged by the charge-removing device 16 so as to prepare for the next image formation.

As shown, the sheet feeding section 4 includes three sheet cassettes 26, 27, and 28 arranged at multiple stages and stacking plural sheets. Further, a sheet feeding path 33 having plural pairs of conveying rollers 32 is provided. The sheet feeding rollers 26*a*, 27*a*, and 28*a* depress the upper most transfer sheet housed in these sheet cassettes 26, 27, and 28, respectively. The upper most sheet is fed toward the sheet-feeding path 33 by the rotation of each of the sheet feeding rollers 26*a*, 27*a*, and 28*a*. When the start switch is operated, any one of the sheet cassettes launches a transfer sheet toward the sheet-feeding path 33. The sheet-feeding path 33 receives and guides the transfer sheet fed by the pair of sheet conveying rollers 32 toward the registration roller 19 in the printer section.

As shown, the developing device 40 is arranged beside the PC drum member 12, and includes a toner-conveying device 50 that takes in and conveys toner. Two component type developer including toner and magnetic carrier (not shown) is contained in the developing device 40. The toner replenished to the developing device by the toner-conveying device 50 is mixed and stirred with the two-component developer stored therein to be used in developing. The developing device 40 includes a T-sensor (not shown) at its bottom. The T-sensor outputs a signal to a control section (not shown) in accordance with a magnetic permeability of the two-component developer stored in the developing device 40. Because a density of the two-component developer correlates to the magnetic permeability, the T-sensor accordingly detects a toner density of the two-component developer.

Further, the toner-conveying device 50 is operated so that when an output signal from the T-sensor approaches a prescribed target value, the control section recovers toner density of the two-component developer whose toner density is decreased during development. Further, because a magnetic permeability of the two-component developer varies depending upon a change in the environment such as humidity and the bulk of the two-component developer, the control section corrects the target value as appropriate. Specifically, the target value is corrected in accordance with an image density of a reference toner image formed on the PC member 12 at a prescribed time. Such image density is recognized using an output from a reflection type photo-sensor (herein after referred to as a P-sensor) capable of detecting a light reflectivity of a reference toner image, for example.

Toner not transferred to the transfer sheet and remaining on the surface of the PC drum 12 at a portion downstream of the transfer nip sticks thereto. Such remaining toner is scraped off by the cleaning device 15 and is stored in the collection tank, not shown.

Figure 9:
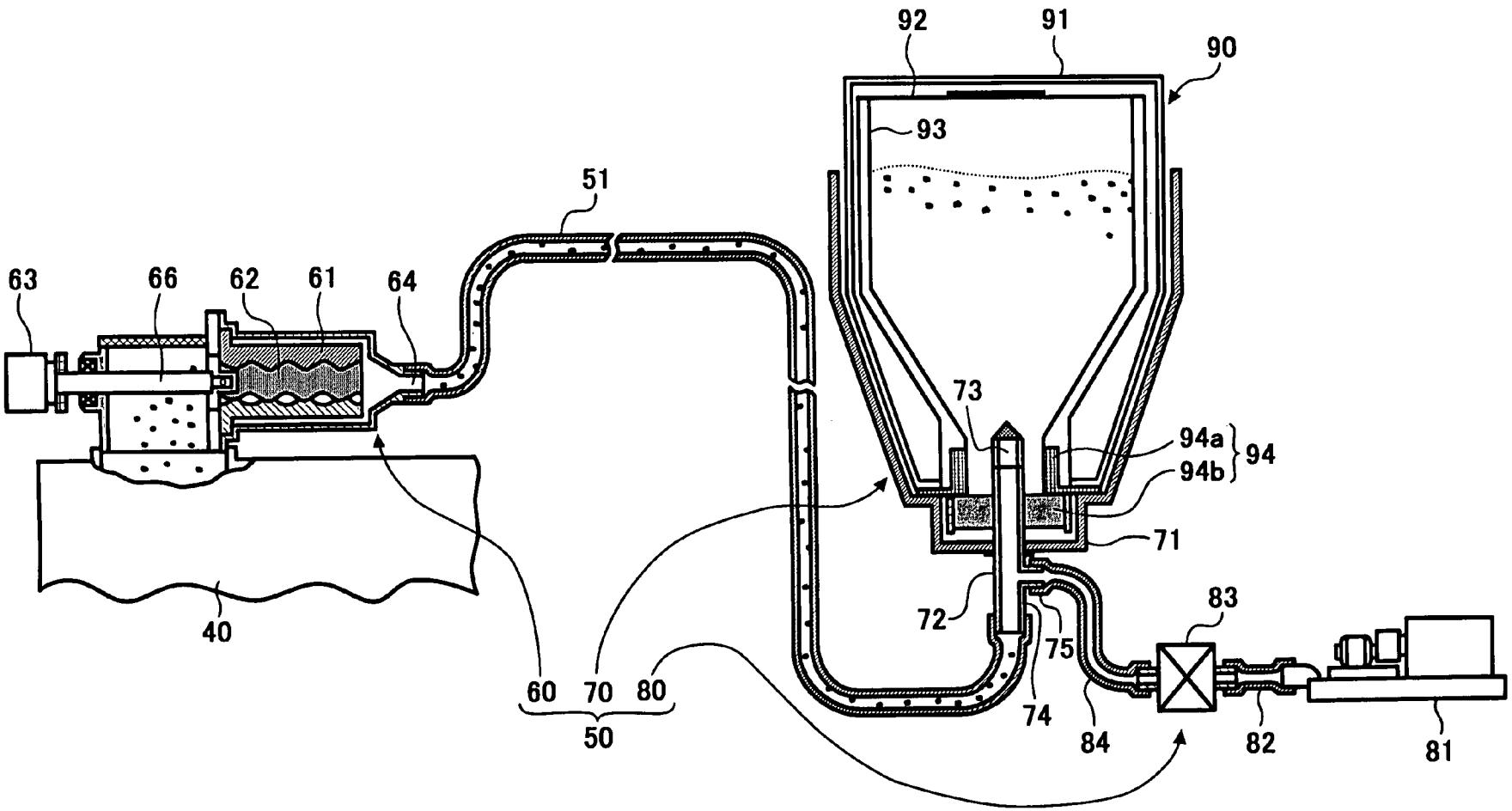
FIG. 9 is a schematic illustrating a specific configuration of a toner conveying apparatus of the copier.

As shown in FIG. 9, the toner-conveying device 50 includes a suction pump 60, a cartridge holder 70, and an air pump section 80. The suction pump 60 is formed from a uniaxial eccentric screw pump or mono-pump, and generates negative pressure in the suction inlet 64 when the suction motor 63 rotates a rotor 62 provided in a stator 61. A tip of a flexible suction tube 51 is connected to the suction inlet 64.

The cartridge holder 70 is formed from a holder section 71 having an opening at its upper side and a nozzle 72 inserted into its bottom surface and so on. The holder section 71 holds a toner cartridge 90. The toner cartridge 90 is made of a member having certain rigidity, such as a paper, a cardboard, a plastic, etc., and wraps a toner-containing bag 92. The toner containing bag 92 is formed from a bag section 93 including mono or multiple layers of sheets each having a thickness of from 80 to 200 μm. As a sheet material, a plastic sheet such as polyethylene, nylon, etc., or a paper may be used. Replenish toner is contained in the toner containing bag 92. A mouthpiece section 94 of the toner-containing bag 92 includes an engagement section 94*b* made of rigid material such as plastic, paper, etc.

The engagement section 94*b* engages with an opening of the bag section 93 and an opening seal section 94*a* made of elastic material such as sponge, etc. The toner cartridge 90 is attached to the holder section 71 of the cartridge holder 70 with its mouthpiece section side directed downward. The tip of the nozzle 72 inserted into the holder section 71 via the bottom surface penetrates the opening seal section 94*a* of the mouthpiece section 94 and enters into the bag section 93. Toner is prevented from leakage from the toner cartridge 90, because the opening seal section 94*a* is tightly connected to a portion around the nozzle 74. The nozzle 72 includes a toner suction inlet 73 at its tip. A T-shape path is formed in the lower side of the nozzle 72 so as to turn off toward a toner passage 74 and an air intake passage 75. Among the same, the rear end of the suction tube 51 is connected to the toner passage 74.

The air pump section 80 is formed from an air pump 81, a relay tube 82, a magnet valve 83 connected to the relay tube 82, and an air supplying tube 84, etc. The air pump 81 supplies air to the air intake passage 75 through all of the relay tube 82, magnetic valve 83, and air supplying tube 84 by operating when the magnet valve 83 is open. The suction pump 60 is configured to refuse fluid from the suction inlet 64 when deactivated. Thus, the air supplied to the air intake passage 75 of the nozzle 72 from the air pump 81 does not flow into the toner passage 74, and enters into the bag section 93 through the toner suction inlet 73 of the nozzle 72. Then, a risk of toner blocking (i.e., toner bridging phenomenon), which occurs in the bag section 96, is suppressed when the toner is stirred and broken into flakes. Further, even if the toner blocking occurs due to the toner not being used for a long period of time, the air or the like collapses thereof. As a result, the toner in the bag section 93 smoothly flows toward the toner suction inlet 73 by gravity, and an amount of the toner remaining in the toner cartridge 90 can be decreased.

Figure 10:
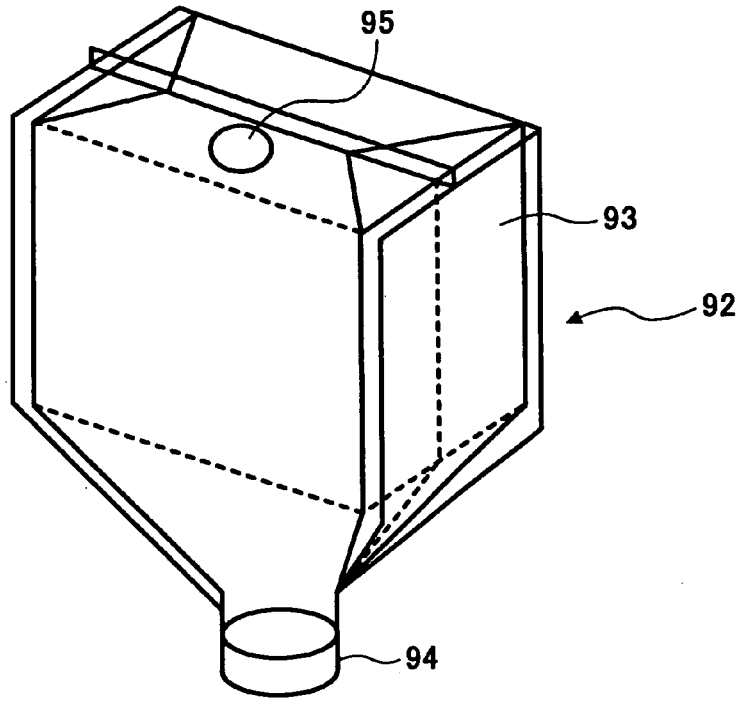
FIG. 10 is a perspective view illustrating a toner-containing bag of a toner cartridge set into the toner conveying apparatus.

FIG. 10 illustrates the toner-containing bag 92. As shown, a ventilating filter 95 is arranged at the bottom of the bag section 93 of the toner-containing bag 92 (i.e., an opposite side to a toner ejecting side). The air supplied to the bag section 93 from the air pump is finally ejected outside through the ventilating filter 95. The ventilating filter 95 has a fine mesh capable of preventing toner particle from passing therethrough. Thus, the air passes the ventilating filter 95 by taking a certain time period, and air pressure in the bag section 93 is temporarily increased when the air pump is driven.

As shown in FIG. 9, the bag section 93, the nozzle 72, suction tube 51, and suction pump 60 are tightly sealed when the magnetic valve 83 is closed. Thus, a suction force is generated at the toner suction inlet 73 when a negative pressure is generated in the suction tube 51 due to an operation of the suction pump 60. Then, the toner in the bag section 93 is sucked through the toner suction inlet 73, and passes the toner passage 74, suction tube 51, and suction pump one after another, thereby entering into the developing device 40 connected to the outside of the suction pump 60.

The suction tube 51 connecting the suction pump 60 to the nozzle 72 has an inner diameter of from 3 to 7 mm, and is made of rubber or plastic material having sufficient flexibility and an anti-toner performance. Polyurethane rubber, nitrile rubber, EPDM rubber, and silicon rubber and so on are exemplified as such excellent material. Polyethylene and nylon or the like are exemplified as such plastic material. By utilizing such a suction tube 51, a toner conveyance passage can be freely arranged in the copier, and a degree of layout freedom is excellent. Further, in the toner-replenishing device 50, even when the toner cartridge 90 is arranged lower than the developing device 40, a conveyance of the toner is enabled if a suction pump 60 having a relatively strong air suction force is used. Thus, a degree of an interior layout freedom of the apparatus is improved, and the toner cartridge 90 can be arranged at the most convenient position for a replacement action.

Figure 11:
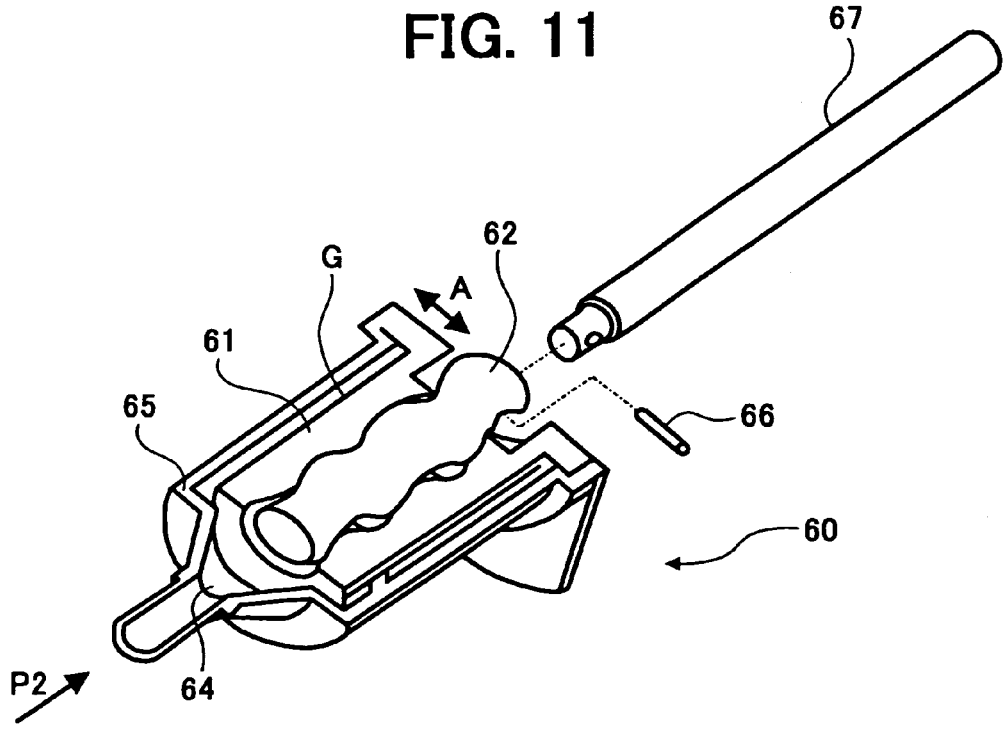
FIG. 11 is an exploded perspective view illustrating a pump section of a suction pump included in the toner conveying apparatus.

Turning now to FIG. 11, which illustrates a pump section of the suction pump 60 with an exploded perspective view. As shown, the pump section includes a stator 61, a rotor 62, and a holder 65 wrapping these devices or the like. The stator 61 has a female screw shape having spiral grooves of a double pitch on an elastic member such as rubber. Further, the rotor 62 is made of a metal or plastic material, etc. and is manufactured by molding in a male screw shape. The rotor 62 is freely rotatably in the spiral grooves of the stator 61. A driving shaft 67 is secured by a spring pin 66, and is connected to the rear side end of the rotor 62.

The holder 65 holds the stator 61 oscillating in a direction shown by an arrow A in FIG. 11 by engaging a flange section disposed at one end of the stator 61 with its inner circumferential surface. Owing to the oscillation, a gap "G" is formed between the inner surface of the holder 65 and the outer surface of the stator 61.

A motor (not shown) is connected to the tip of the driving shaft 67, and the rotor 62 rotating in the stator 61 accompanies its rotation. Simultaneously, the rotor 62 performs eccentric rotation due to its complex shape. That is why the suction pump 60 is called a uniaxial eccentric screw pump. When the rotor 62 performs the eccentric rotation, the stator 61 oscillates in the direction shown by the arrow A. When a suction force P2 is generated at the suction inlet 64 by the rotation of the rotor 62, toner is sucked in from the suction inlet 64. The toner then passes through the interior of the pump section and is ejected from an ejection outlet disposed below the driving shaft 67.

Figure 12A:
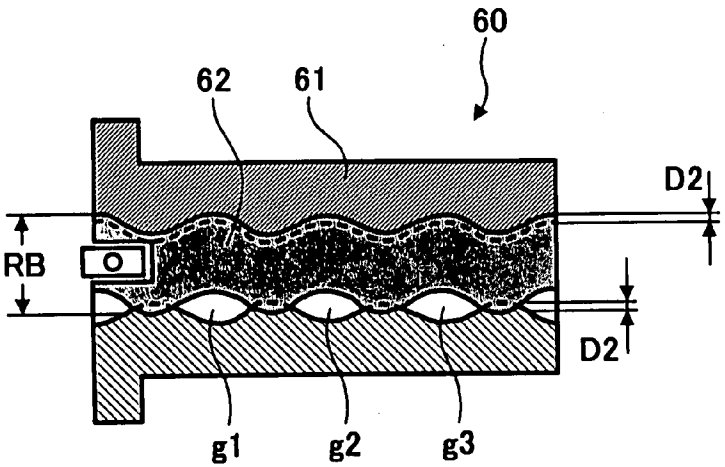
FIG. 12A is a vertical cross sectional view illustrating the pump section in which a rotor fits into a stator.
Figure 12B:
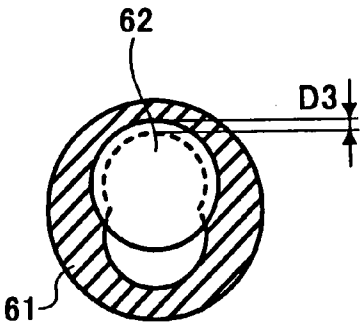
FIG. 12B is a horizontal cross sectional view illustrating a condition of the rotor stopping while deviating to one end of the inner diameter of the stator.
Figure 12C:
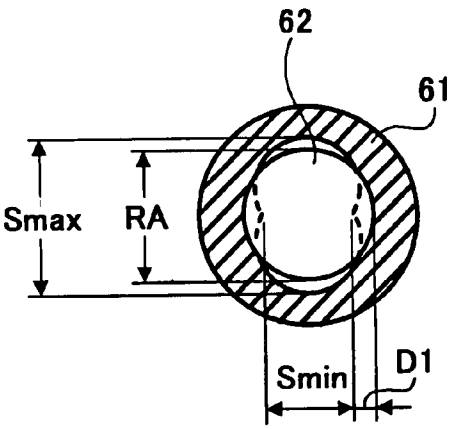
FIG. 12C is a lateral cross sectional view illustrating a condition of the rotor positioning almost at a center of the inner diameter of the stator.

FIG. 12A illustrates a condition of the stator 61 engaging with the rotor 62. As shown, the legend D2 denotes an amount of breaking of the spiral outer diameter of the rotor 62 into the inner diameter of the stator 61. FIG. 12B illustrates a condition of the rotor 62 stopping while inclining to the one side of the inner diameter of the stator 61. As shown, the legend D3 denotes an amount of breaking of the rotor 62 into the stator 61 around its end. FIG. 12C illustrates a condition of the rotor 62 positioned at almost the center of the inner diameter of the stator 61. As shown, the legend D1 denotes an amount of breaking of the rotor 62 into the least inner diameter section of the stator 61.

According to the test conducted by the present inventors, it is important for the suction pump 60 that the above-described breaking amounts D1 to D3 are set when obtaining prescribed ejection and sucking pressures. Thus, as shown in FIG. 12A, gaps g1 to g3 are formed between the rotor 62 and stator 61. These gaps are separated from each other and tightly sealed while the rotor 62 breaks into the stator 61 by the three breaking amounts. When the rotor 62 rotates, these three tightly sealed gaps g1 to g3 accordingly rotate and convey toner stored therein toward an ejection side. The toner is ejected in the ejecting side when the rotor 62 is placed at a prescribed rotational position and the gap g1 is open. In contrast, a suction side is brought into a tightly sealed condition again while involving ambient air and toner when the rotor 62 is placed at the prescribed rotational position and the gap g3 is open. As a result, the ejection and suction pressures are generated in the ejecting and suction sides of the suction pump 60.

When the ejection and suction are to be increased, a tightly sealed level of each of the gaps g1 to g3 is preferably increased. Specifically, the above-described breaking amounts D1 to D3 are increased. Then, a torque of the suction pump 60 can be increased. However, when the breaking amounts are increased, because the inner temperature increases, the toner readily agglutinates inside the suction pump 60. In contrast, when the breaking amount is decreased, the toner suction force and toner conveyance force of the suction pump 60 are weakened due to the decrease in torque. However, toner aggregation generated by an increase in temperature hardly appears.

According to the copier of this example, the three breaking amounts D1 to D3 are appropriately set to prescribed levels found by the present inventors through their investigation. The appropriate amount is a level capable of avoiding a change in a toner aggregation level around the time when toner passes through the suction pump 60 and obtaining (exerting) a prescribed toner conveying force. Thus, the suction pump 60 can credibly convey toner and suppress an abnormal image caused by the toner aggregation.

Figure 13:
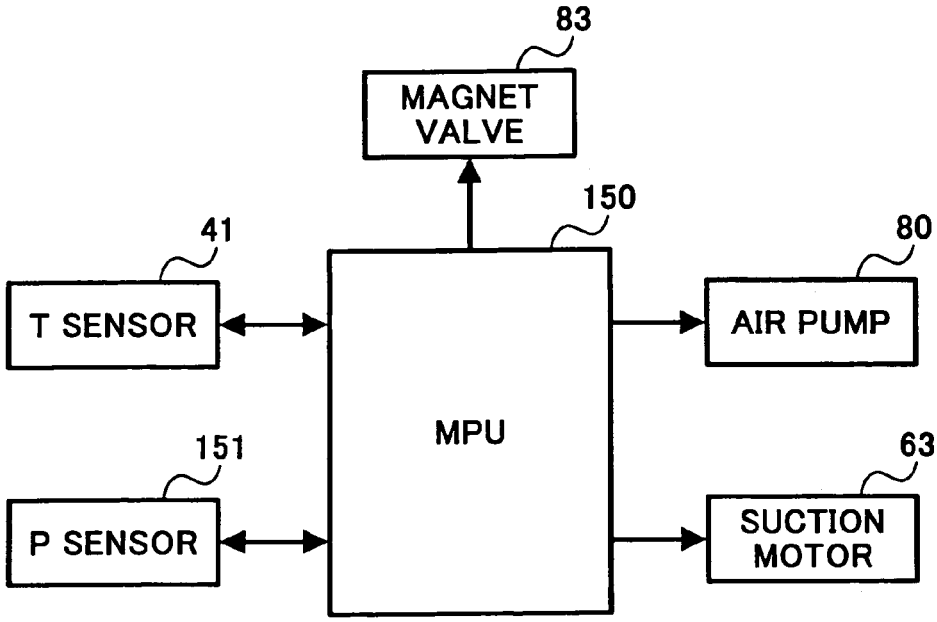
FIG. 13 is a block diagram illustrating a portion of the electric circuit of the copier.

FIG. 13 partially illustrates one example of an electric circuit of a copier. As shown, a MPU 150 serves as a control device of the copier. A P-sensor 151 detecting a density of a reference toner image formed on a PC member, and a T-sensor 41 disposed in the developing device 40 are connected to the MPU 150. Also connected thereto are the suction motor 63 disposed in the toner-conveying device 50, the air pump 80, and the magnet valve 83. The MPU 150 controls the suction motor 63 to operate and thereby replenish toner into the developing device 40 in accordance with an output value transmitted from the P-sensor 151. The MPU 150 times, accumulates and counts a toner replenishing time period (i.e., a driving time period of the suction motor). The MPU 150 controls the air pump 80 to supply air so as to stir the toner stored in the toner cartridge 90. Further, because a power is supplied to the MPU 150 even when a main power supply (not shown) of the copier is turned OFF, an accumulated count value stored in a memory as the toner replenishing time period is maintained.

Figure 14:
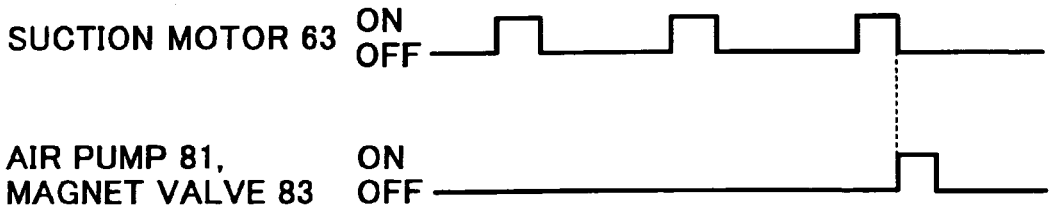
FIG. 14 is a timing diagram illustrating an operational sequence of a suction motor, an air pump, and a magnetic valve included in the toner conveying apparatus.

FIG. 14 illustrates sequential operations of the suction motor 63, air pump 80, and magnetic valve 83. As shown, the suction motor 63 is turned ON and OFF in accordance with a signal output from the P-sensor 151. When the accumulative count value corresponding to the toner replenishing operation time period obtained by the suction motor 63 reaches a prescribed level, the air pump 81 and magnetic valve 83 are controlled to operate after the suction motor 63 is stopped. Then, the toner stored in the toner cartridge 90 is stirred. As shown in FIG. 9, when the suction pump 60 has sucked the air supplied by the air pump 81, because air convection is insufficient in the toner cartridge 90, a toner stirring performance is significantly decreased. Then, the air pump 81 and magnetic valve 83 (e.g., opening when power is supplied) are driven only when the suction motor 63 and suction pump 60 are stopped.

Figure 15:
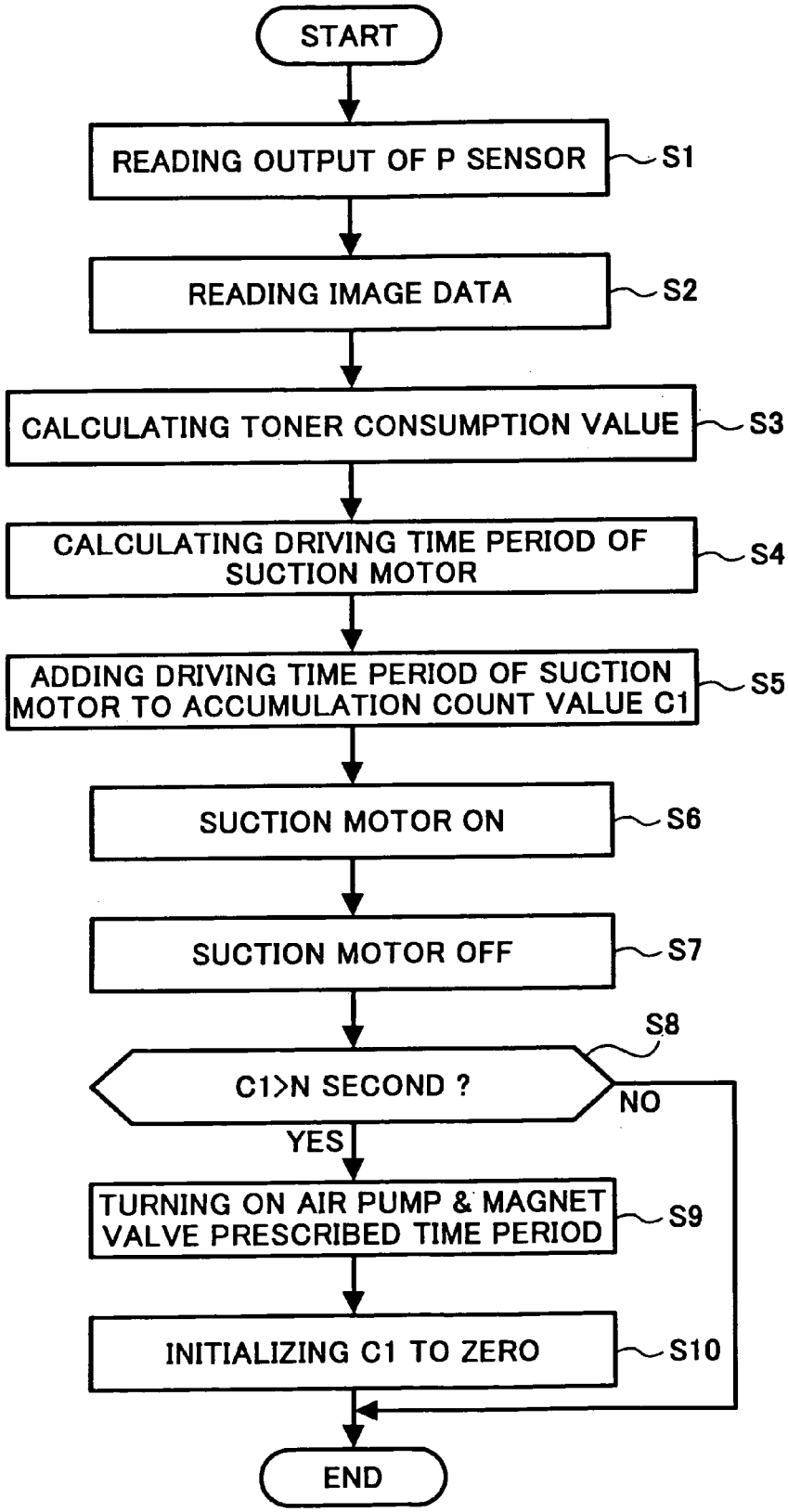
FIG. 15 is a flowchart illustrating a toner replenishing controlling operation executed by a micro processing unit (MPU) of the copier.

FIG. 15 illustrates one example of toner replenishment control executed by the MPU 150. When toner replenishment is controlled, the MPU 150 initially reads an output value output from the P-sensor 151 (in step S1), and then reads a rate of an area of an image output therefrom (in step S2). Then, based upon the output from the P-sensor and image area rate, a toner consumption amount is calculated (in step S3). Further, a time period for driving the suction motor 63 is calculated based upon the consumption calculation (in step S4). Then, the driving time period is added to the accumulative count value C1 indicating the previous toner replenishment operation (in step S5). Simultaneously, the suction motor 63 is driven for the driving time period (in steps S6 and S7). Then, it is determined if the accumulative value C1 exceeds N-seconds (in step S8). When N-seconds are exceeded (Yes, in step S8), the air pump 81 and magnetic valve 83 are driven for a prescribed time period (in step S9), and the accumulative count value C1 is initialized (in step S10), thereby toner replenishment control is terminated. In contrast, when N-seconds are not exceeded (No, in step S8), the toner replenishment control is terminated.

Figure 16:
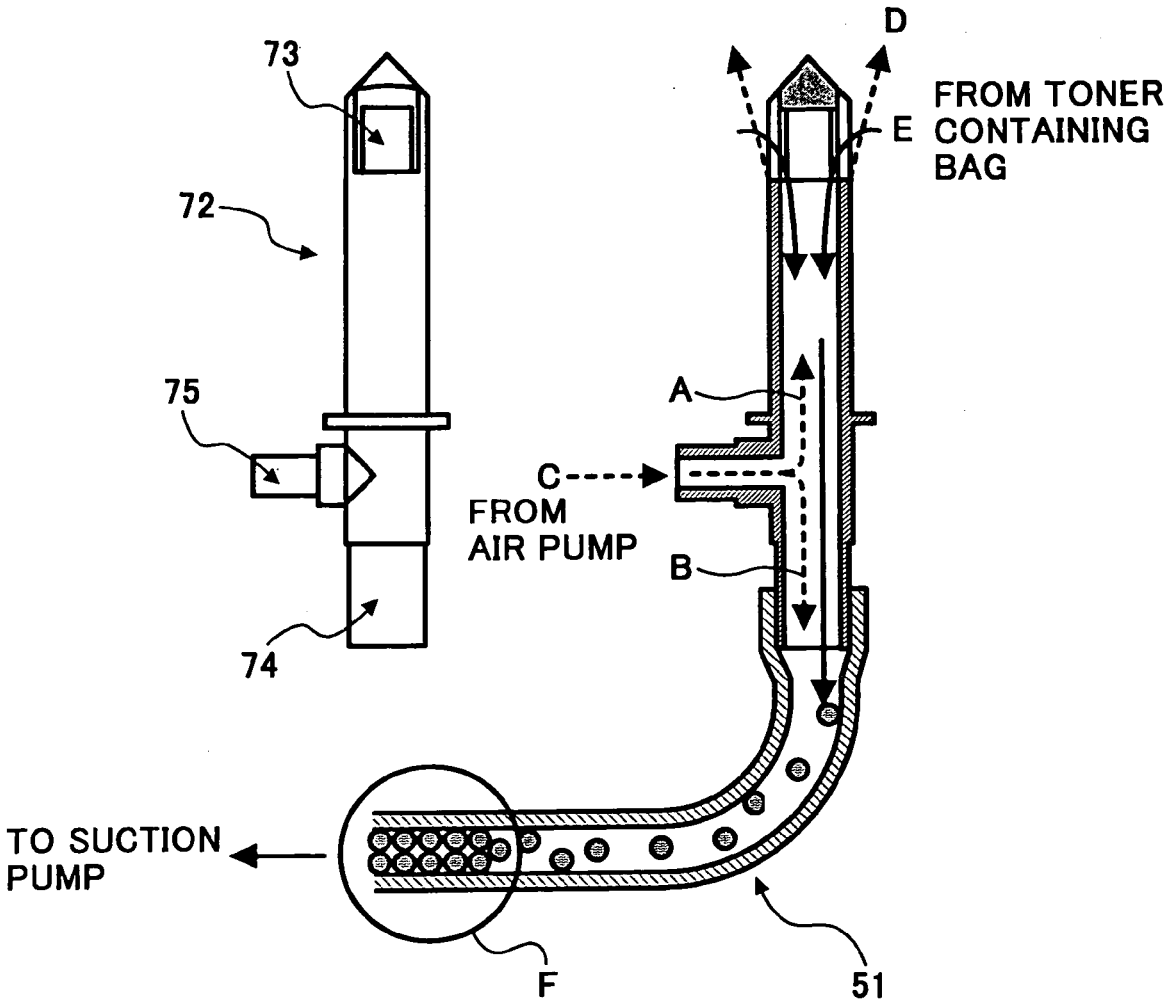
FIG. 16 is side and cross sectional views illustrating a nozzle included in the toner replenishing apparatus.

A typical configuration of a copier is now described with reference to FIG. 16. As shown, the nozzle 72 of the toner-replenishing device 50 is illustrated. An arrow D shown by a dotted line indicates a moving direction of an air supplied by the air pump 81. A solid line arrow E indicates a moving direction of a toner. Air supplied by the air pump 81 (not shown) moves in a direction shown by doted line arrows C and A in the drawing. Specifically, the air passes through the air passage 75 of the nozzle 72, and then enters into a toner-containing bag (not shown) through the toner suction inlet 73, thereby stirring the toner. Thus, the air entered into the toner-containing bag is ejected from the ventilating filter 95 (see FIG. 10). However, because the ejection takes a certain time period, air pressure in the bag is increased. As a result, a part of the air having passed through the air acceptancy passage 75 moves toward a toner passage 74 (i.e., a direction shown by a dotted line arrow "B"), instead of a direction toward the toner suction inlet, and depresses the toner stored in the suction tube 51. When such depression is periodically repeated by driving the air pump 81, the toner agglutinates within the suction tube 51 (at a position "F" in the drawing). Such toner aggregation increases and cannot be conveyed by the suction pressure of the suction pump 60.

Figure 17:
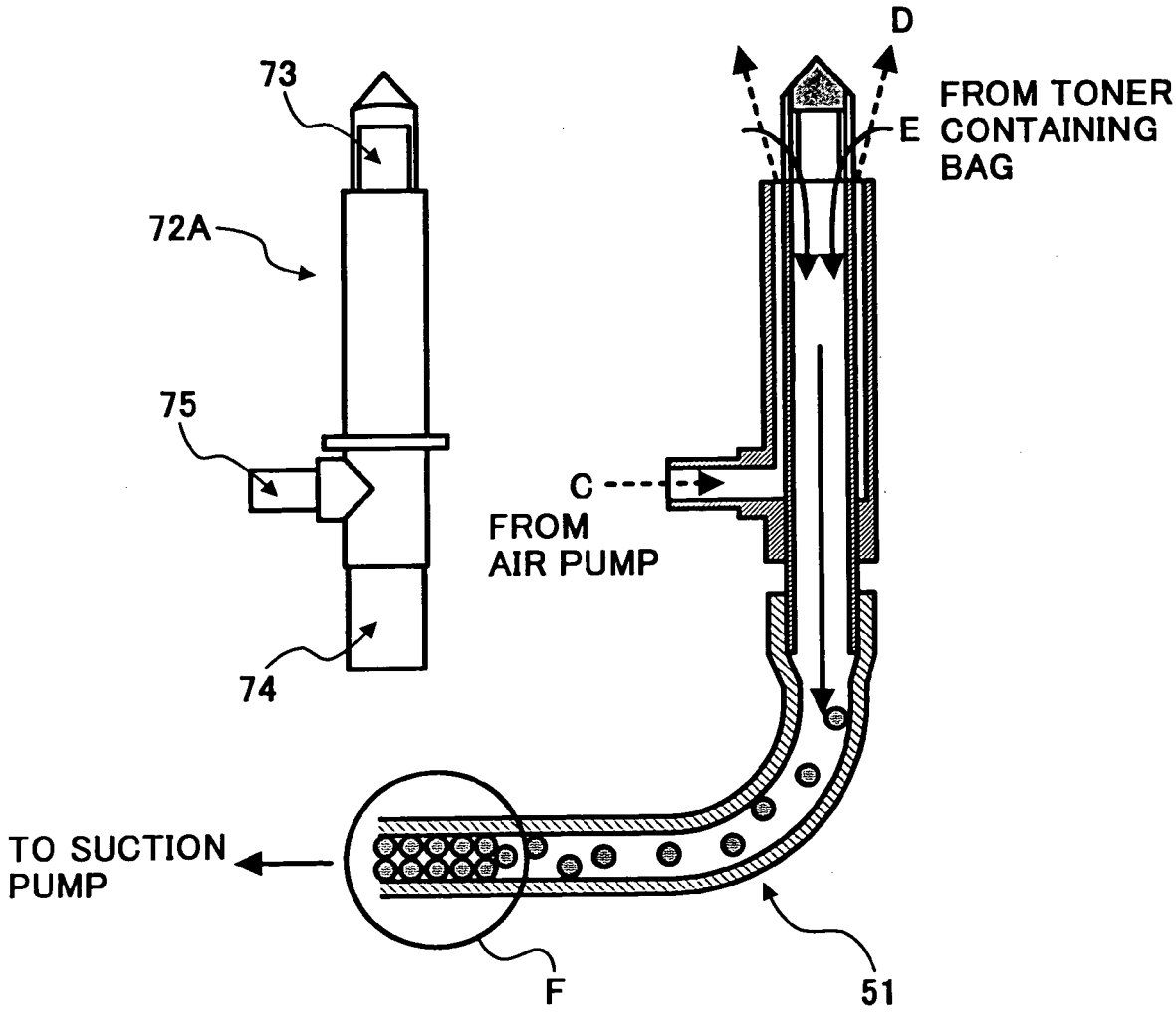
FIG. 17 is side and cross sectional views illustrating a nozzle employing a double nozzle system.

FIG. 17 illustrates a modification of the nozzle 72. The modified nozzle 72A uses a double pipe nozzle system. The double pipe nozzle system does not form a T-shaped bifurcation in the nozzle. The air supplied by the air pump 81 (not shown) is controlled to enter into a toner-containing bag through a gap formed between the external and internal pipes. The internal pipe is formed longer than the external pipe, and configured to protrude from the tip of the external pipe. The toner suction inlet 73 is formed at the protruding section. The toner stored in the toner containing bag is sucked from the toner suction inlet 73 by driving the suction pump 60 (not shown) and is conveyed through the suction tube 51. Even though such a configuration of a nozzle 72A is used, and when an inner pressure of the toner-containing bag is increased by supplied air, the inner air enters into the suction tube 51 from the toner suction inlet 73 and depresses the toner stored in the suction tube 51. As a result, toner aggregation occurs.

The copier instructs a user to use toner having any one of below listed performances. Such instruction is made by clearly describing information of toner to be used (e.g., one of an aspect, type, product name, and product number) in an operating manual or brochure of the copier. Further, the information can be clearly described on the copier, or a seal having a description of the information is affixed thereto. A manufacturer or dealer can also instruct a user via a document, electronic data, orally, etc.

As a first type of toner, the maximum shearing stress ($\tau$ max) is less than 30 G ($N/m^2$) when a shearing tester 100 applies a vertical stress of 16 G ($N/m^2$). As a second type toner, a uniaxial collapsing stress (fc) is less than 50 G ($N/m^2$) when measured by using a uniaxial collapsing stress measuring method with the shearing tester 100.

In a copier having such a configuration, toner having a maximum shearing stress ($\tau$ max) less than 30 G ($N/m^2$) when a vertical stress of 16 G ($N/m^2$) is applied, or a uniaxial collapsing stress (fc) less than 50 G ($N/m^2$) having preferable fluidity is used. Thus, even if toner suction and air supplying from and to the toner cartridge 90 (more precisely, the toner containing bag 92) are simultaneously performed, toner aggregation can be suppressed in the suction tube 51. As a result, clogging of the toner can be suppressed. Further, an overload of the suction pump 60 caused by the toner clogging can be suppressed, and damage of the suction pump 60 can be suppressed.

Further, if the maximum shearing stress 16 G ($\tau$ max) caused when a vertical stress of 16 G ($N/m^2$) is applied is used as a reference index representing a tendency of toner clogging instead of the uniaxial collapsing stress (fc), the fluidity testing method can be simplified and toner control can be readily performed.

That is, the tendency of toner clogging can be recognized by measuring the maximum shearing stress only once when the maximum shearing stress of 16 $\tau$ max is used. In contrast, the tendency of toner clogging can be recognized more precisely by using the uniaxial collapsing stress (fc) when the maximum shearing stress of 16 $\tau$ max is used.

As described above, the copier using the developing system using two components type developer including toner and magnetic carrier. However, the present invention can be applied to a developing system using a single type developer excluding a magnet carrier. Further, the present invention can also be applied to other type of image forming apparatuses, such as a printer, a facsimile, etc. Further, LED exposure can be used for the laser light exposure. The latent image can be formed by applying ions. Further, the present invention can also be applied to another image forming system not using an electrophotographic process. A direct recording system as described in Japanese Patent Application Laid Open No. 11-301014 is exemplified as such an image forming system. Still further, the present invention can also be applied to a toner conveying apparatus. Further, the configuration of the toner-conveying device of FIG. 9 is one example and does not limit the scope of the invention.

Figure 18:
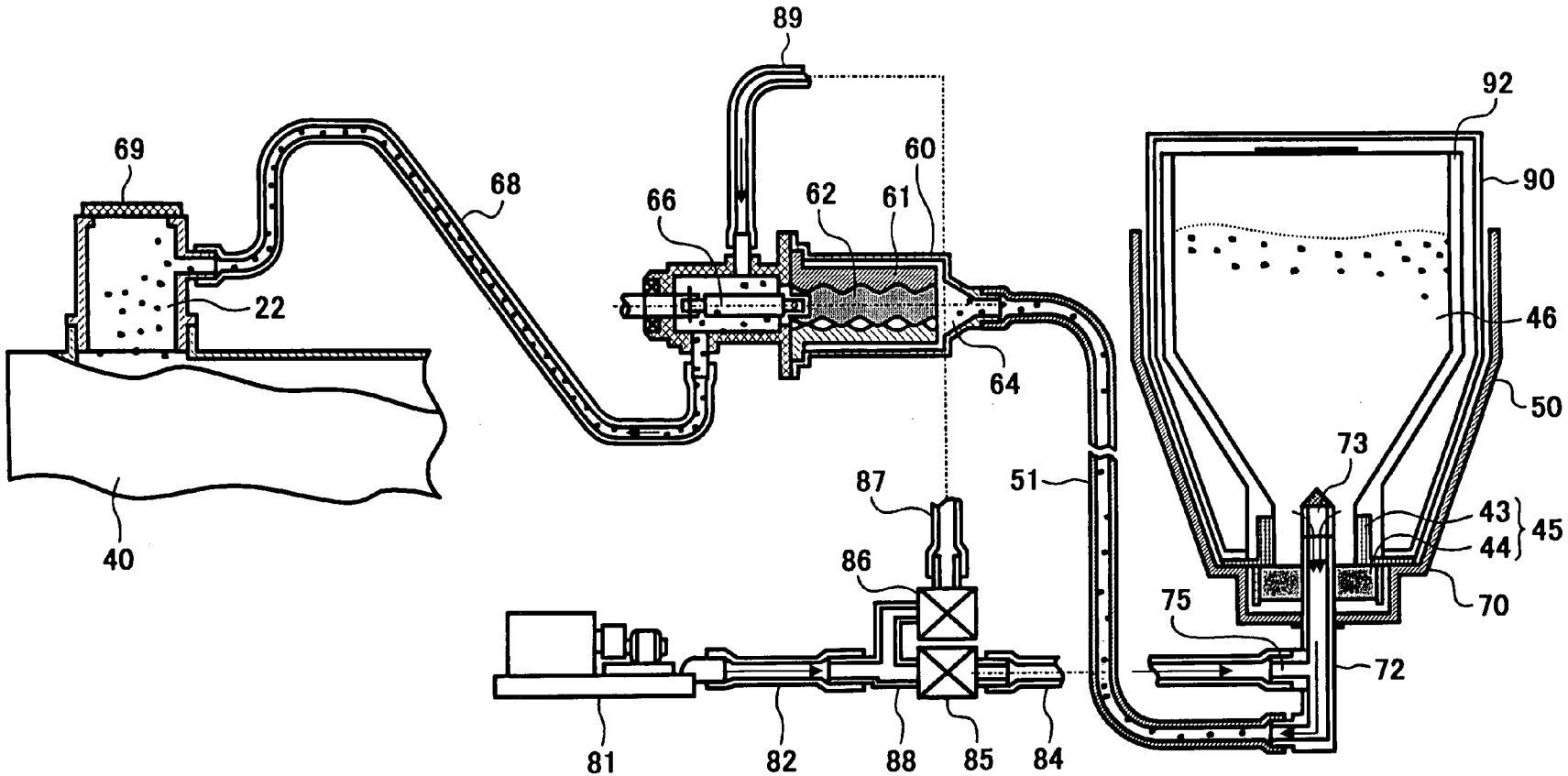
FIG. 18 is a schematic illustrating a modification of the toner conveying apparatus.

Turning now to FIG. 18, which illustrates a modification of the toner-conveying device 50. An ejection tube 68 connects a hopper 69 to an ejection side of a modified suction pump 60 at both tips. Toner ejected to the hopper 69 via the tube 68 is supplied to the developing device 40. The relay tube 82 connected to the outlet of the air pump 81 is connected to a flow divider pipe 88 bifurcating to be connected to first and second magnetic valves 85 and 86. The tip of the first magnetic valve 85 is connected to the air acceptance passage 75 of the nozzle 72 through the air supplying tube 84. The tip of the second magnetic valve 86 is connected to the suction pump 60 at its ejecting side through the flow divider tube 89.

Because the toner conveyance passage starting from the ejecting side of the suction pump 60 to the tip of the tube 68 is sealed off, toner ejected is pressure conveyed through the tube 68 and reaches the hopper 69. Simultaneously, toner residing in the vicinity of the trailing end of the tube 68 is pressure conveyed while receiving a weight of the toner residing in the vicinity of the tip. However, because the toner having the above-mentioned performance is used, toner clogging within the tube 68 can be suppressed. Further, when the air pump 60 is turned ON, the first magnetic valve 85 is turned OFF (i.e., closed), the second magnetic valve is turned ON (i.e., open), and air supplying from the air pump 60 is led to the ejecting outlet of the suction pump 60. Then, toner ejected from the suction pump 60 is conveyed through the tube 68 while being fluidized. Thus, toner clogging within the tube 68 is suppressed. When the air pump 60 is turned ON, the first magnetic valve 85 is turned ON, the second magnetic valve is turned OFF, and air supplied by the air pump 60 is led to the toner-containing bag 92. Then, the air stirs toner in the bag.

Figure 19:
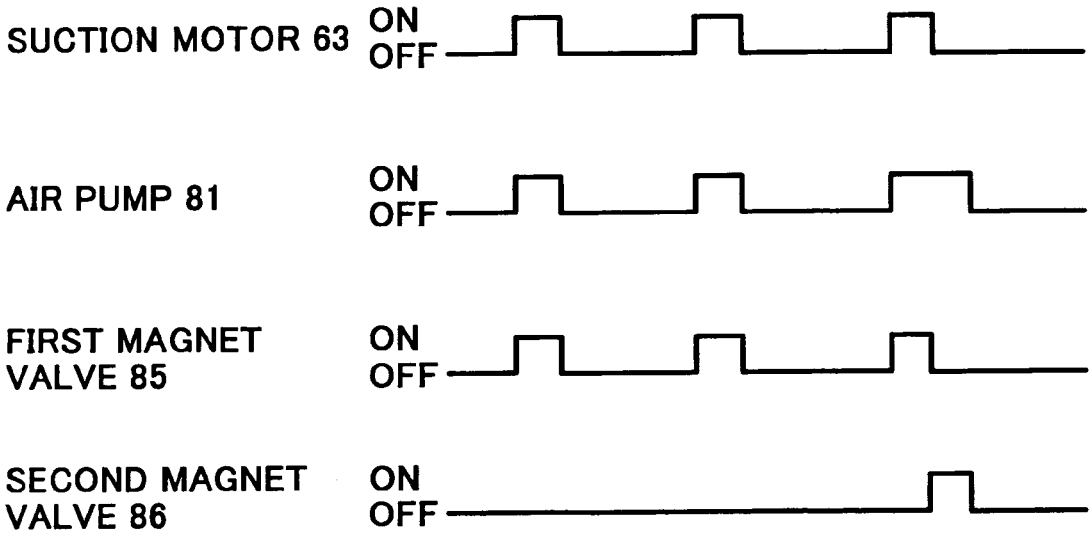
FIG. 19 is a timing diagram illustrating an operational sequence of a suction motor, an air pump, and first and second magnetic valves included in the modified toner conveying apparatus.

FIG. 19 illustrates an operational sequence of the suction motor 63, the air pump 81, and the first and second magnetic valves 85 and 86. When the accumulated count value C1 corresponding to the toner replenishing time period exceeds N-seconds, the air pump 60 and the first magnetic valve 85 are turned ON, and the second magnetic valve 85 is turned OFF after the suction motor 63 is stopped. Then, air is supplied and led by the air pump 60 to the toner-containing bag 92 so as to stir and fluidize the toner in the bag, thereby preventing toner blocking. Accordingly, because the toner stored in the toner-containing bag 92 is almost completely sucked out of the cartridge, little toner is wasted when the cartridge is replaced.

According to this embodiment, the air pump 80 supplies air to the toner cartridge 90 in the toner conveyance device 50. The suction tube 51 and suction pump 60 also generate a negative pressure in the suction tube 51. Further, toner having the above-described performance is used. With such a configuration, even when both toner is sucked and air is supplied to the toner cartridge simultaneously, toner can be conveyed while toner clogging is suppressed in the suction tube 51. Further, by using the toner having the above-described performance, and thereby suppressing toner clogging in the suction tube 51 of the toner-conveying device 50 in the copier of this example, toner-conveying control can be stable. In addition, because a PC member 12 and a developing device 40 are used to form a toner image using an electrophotographic process, toner can be stably replenished from a toner cartridge 90 to a developing device 40. Thus, a toner density in a developing device 40 can be stably maintained. Further, a lifting range between a toner cartridge 90 and a developing device 40 as a conveyance destination, and an entire length of a suction tube 51 are less than 1 m, and a negative pressure caused by the suction pump is more than 10 kilo PASCAL as tested by the inventors. Accordingly, the above-described condition can further suppress toner clogging in the suction tube 51.

Numerous additional modifications and variations of the present invention are possible in light of the above teachings. It is therefore to be understood that within the scope of the appended claims, the present invention may be practiced otherwise that as specifically described herein.

What is claimed is:

1. A method for conveying toner, comprising:

supplying toner having one of a maximum shearing stress less than about 30 G ($N/m^2$) and a uniaxial collapsing stress less than about 50 G ($N/m^2$) to a toner container;

sucking the toner from the toner container to a prescribed position through a flexible pipe; and supplying air to the toner container;

wherein said maximum shearing stress is measured by a shearing tester when a toner layer with the toner is formed on a fixed plate of the shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 16 G to the toner layer; and wherein said uniaxial collapsing stress is measured by a shearing tester when a toner layer with the toner is formed on a fixed plate of a shearing tester, a vertical stress is applied to the toner layer through a movable plate and a first weight for about five minutes, the first weight is replaced with a second weight lighter than the first weight, and the movable plate is horizontally drawn while applying 200 G to the toner layer.

2. A method of forming a toner image, comprising:

supplying toner having one of a maximum shearing stress less than about 30 G (N/m2) and a uniaxial, collapsing stress less than about 50 G ($N/m^2$) to a toner container;

sucking the toner from the toner container to a prescribed image formation position through a flexible pipe;

supplying air to the toner container; and forming a toner image using the toner;

wherein said maximum shearing stress is measured by a shearing tester when a toner layer with the toner is formed on a fixed plate of the shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 16 G to the toner layer; and wherein said uniaxial collapsing stress is measured by a shearing tester when a toner layer with the toner is formed on a fixed plate of a shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 200 G to the toner layer.

3. The method as claimed in claim 1, wherein each of said steps of sucking the toner and supplying the air is performed at a different time from each other.

4. The method as claimed in claim 1, wherein said prescribed position is located in a developing apparatus arranged above the toner container.

5. The method as claimed in claim 4, wherein said toner container is arranged beside a sheet feeding section arranged below a printing section.

6. The method as claimed in claim 2, wherein each of said steps of sucking the toner and supplying the air is performed at a different time from each other.

7. The method as claimed in claim 2, wherein said prescribed position is located in a developing apparatus arranged above the toner container.

8. The method as claimed in claim 7, wherein said toner container is arranged beside a sheet feeding section arranged below a printing section.

9. A method for conveying toner, comprising:

supplying toner having one of a maximum shearing stress less than about 30 G ($N/m^2$) and a uniaxial collapsing stress less than about 50 G ($N/m^2$) to a toner container; and sending the toner from the toner container to a developing device using a pump arranged between the toner container and the developing device;

wherein said maximum shearing stress is measured by a shearing tester when a toner layer with toner is formed on a fixed plate of the shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 16 G to the toner layer; and wherein said uniaxial collapsing stress is measured by a shearing tester when a toner layer with toner is formed on a fixed plate of the shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 200 G to the toner layer.

10. The method as claimed in claim 9, wherein said toner container and the pump are connected to each other via a suction tube, and wherein said pump and the developing device are connected to each other via an ejection tube.

11. The method as claimed in claim 10, wherein said suction tube is connected to a nozzle arranged below the toner container, and wherein the toner is sucked by the pump from the toner container through the suction tube.

12. The method as claimed in claim 10, wherein said ejection tube is connected to a hopper arranged above the developing device, wherein the toner is supplied to the hopper by the pump via the ejection tube, and wherein the toner is supplied to the developing apparatus from the hopper.

13. The method as claimed in claim 12, wherein said pump includes a suction pump and an air pump.

14. The method as claimed in claim 13, wherein said suction pump sucks the toner from the toner container, and wherein said air pump supplies air to the toner container.

15. The method as claimed in claim 14, wherein said air pump transfers the toner sucked by the suction pump to the developing apparatus.

16. The method as claimed in claim 15, wherein said air pump is connected to a flow divider pipe having bifurcated exits via a relay tube, and wherein one of the bifurcated exits is connected to the toner container via a first magnetic valve, the air supply tube, and the nozzle.

17. The method as claimed in claim 16, wherein the other one of the bifurcated exits is connected to the ejection section of the suction pump via a second magnetic valve and the flow divider tube.

18. The method as claimed in claim 17, wherein the first and second magnetic valves are controlled such that when the first magnetic valve is open, the second magnetic valve is closed, and vice versa.

19. A method for forming a toner image, comprising:

supplying toner having one of a maximum shearing stress less than about 30 G ($N/m^2$) and a uniaxial collapsing stress less than about 50 G ($N/m^2$) to a toner container;

sending the toner from the toner container to a developing device using a pump arranged between the toner container and the developing device; and forming a toner image using the toner;

wherein said maximum shearing stress is measured by a shearing tester when a toner layer with toner is formed on a fixed plate of the shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 16 G to the toner layer; and wherein said uniaxial collapsing stress is measured by a shearing tester when a toner layer with toner is formed on a fixed plate of the shearing tester, a vertical stress of about 700 G ($N/m^2$) is applied to the toner layer through a movable plate and a first weight for about five minutes, the first weight is replaced with a second weight lighter than the first weight, and the movable plate is horizontally drawn while applying 200 G to the toner layer.

20. The method as claimed in claim 19, wherein said toner container and the pump are connected to each other via a suction tube, and wherein said pump and the developing device are connected to each other via an ejection tube.

21. The method as claimed in claim 20, wherein said suction tube is connected to a nozzle arranged below the toner container, and wherein the toner is sucked by the pump from the toner container through the suction tube.

22. The method as claimed in claim 20, wherein said ejection tube is connected to a hopper arranged above the developing device, wherein the toner is supplied to the hopper by the pump via the ejection tube, and wherein the toner is supplied to the developing apparatus from the hopper.

23. The method as claimed in claim 22, wherein said pump includes a suction pump and an air pump.

24. The method as claimed in claim 23, wherein said suction pump sucks toner from the toner container, and wherein said air pump supplies air to the toner container.

25. The method as claimed in claim 24, wherein said air pump transfers the toner sucked by the suction pump to the developing apparatus.

26. The method as claimed in claim 25, wherein said air pump is connected to a flow divider pipe having bifurcated exits via a relay tube, and wherein one of the bifurcated exits is connected to the toner container via a first magnetic valve, the air supply tube, and the nozzle.

27. The method as claimed in claim 26, wherein the other one of the bifurcated exits is connected to the ejection section of the suction pump via a second magnetic valve and the flow divider tube.

28. The method as claimed in claim 27, wherein the first and second magnetic valves are controlled such that when the first magnetic valve is open, the second magnetic valve is closed, and vice versa.

* * * * *